US010024224B2

(12) United States Patent
Yamazaki et al.

(10) Patent No.: US 10,024,224 B2
(45) Date of Patent: Jul. 17, 2018

(54) ROTARY CARBURETOR FOR TWO-STROKE INTERNAL COMBUSTION ENGINE

(71) Applicant: YAMABIKO CORPORATION, Tokyo (JP)

(72) Inventors: Takahiro Yamazaki, Tokyo (JP); Shirou Yamaguchi, Tokyo (JP); Takamasa Otsuji, Tokyo (JP); Hidekazu Tsunoda, Tokyo (JP)

(73) Assignee: Yamabiko Corporation, Tokyo (JP)

( * ) Notice: Subject to any disclaimer, the term of this patent is extended or adjusted under 35 U.S.C. 154(b) by 0 days.

(21) Appl. No.: 15/346,745

(22) Filed: Nov. 9, 2016

(65) Prior Publication Data

US 2017/0130642 A1 May 11, 2017

(30) Foreign Application Priority Data

Nov. 10, 2015 (JP) ..... 2015-220676

(51) Int. Cl.

| | |
|---|---|
| ***F02B 25/00*** | (2006.01) |
| ***F02B 25/22*** | (2006.01) |
| ***F02B 75/02*** | (2006.01) |
| ***F02M 9/08*** | (2006.01) |
| ***F02M 35/10*** | (2006.01) |
| ***F02M 35/108*** | (2006.01) |

(Continued)

(52) U.S. Cl.

CPC ..... *F02B 25/22* (2013.01); *F02B 25/14* (2013.01); *F02B 33/04* (2013.01); *F02B 75/02* (2013.01); *F02M 9/08* (2013.01); *F02M 35/108* (2013.01); *F02M 35/1019* (2013.01); *F02M 35/10196* (2013.01); *F02B 2075/025* (2013.01)

(58) Field of Classification Search

CPC ..... F02B 25/22; F02B 33/04; F02B 25/14; F02B 75/02; F02B 2075/025; F02M 35/108; F02M 35/10196; F02M 9/08; F02M 35/1019

See application file for complete search history.

(56) References Cited

U.S. PATENT DOCUMENTS

| | | | | |
|---|---|---|---|---|
| 6,289,856 | B1 | 9/2001 | Noguchi | |
| 2009/0072417 | A1 * | 3/2009 | Koizumi | F02M 9/08 261/44.8 |

(Continued)

*Primary Examiner* — Hung Q Nguyen

(74) *Attorney, Agent, or Firm* — Kilyk & Bowersox, P.L.L.C.

(57) ABSTRACT

To allow an intake negative pressure to directly act on a fuel outlet formed on a nozzle tube, and to guide a fuel discharged from the fuel outlet in the nozzle tube to the fuel-air mixture passage. A rotary carburetor (200) has a guide plate member (42) downstream of a fuel outlet (30) located in a through-hole (14). The guide plate member (42) has both side edges (42*b*) away from an inner wall surface (14*a*) of the through-hole (14). The through-hole (14) is divided by the guide plate member (42) into a first passage portion (44) and a second passage portion (46). The first passage portion (44) communicates through a piston groove with a scavenging passage of a cylinder. The fuel discharged from the fuel outlet (30) is guided by the guide plate member (42) to the second passage portion (46) and is supplied through the second passage portion (46) to a fuel-air mixture passage (24) of an engine intake system.

7 Claims, 23 Drawing Sheets

(51) Int. Cl.
*F02B 25/14* (2006.01)
*F02B 33/04* (2006.01)

(56) References Cited

U.S. PATENT DOCUMENTS

2012/0234304 A1 9/2012 Ono et al.
2012/0240907 A1 9/2012 Watanbe et al.

* cited by examiner

ROTARY CARBURETOR FOR TWO-STROKE INTERNAL COMBUSTION ENGINE

BACKGROUND OF THE INVENTION

The present application claims a priority from Japanese Patent Application No. 2015-220676, filed Nov. 10, 2015, which is incorporated herein by reference.

The present invention relates to a rotary carburetor for a two-stroke internal combustion engine and, more particularly, to a rotary carburetor preferably applicable to a stratified scavenging engine. The present invention typically preferably applied to a single cylinder engine mounted on a portable working machine such as a bush cutter, a chain saw, and a power blower.

A stratified scavenging engine is known as one form of two-stoke internal combustion engines (Patent Document 1). The stratified scavenging engine is characterized by a scavenging stroke. In the scavenging stroke of the stratified scavenging engine, a leading air is introduced into a combustion chamber in an early phase thereof. Subsequently, a fuel-air mixture pressurized in a crank chamber is supplied through a scavenging passage to the combustion chamber. Before the scavenging stroke, the scavenging passage is obviously filled with an air through a piston groove. The scavenging passage communicates with the combustion chamber and the crank chamber. The communication between the scavenging passage and the combustion chamber is opened and closed by a piston. The piston groove means a groove formed in a circumferential surface of the piston.

A large number of portable working machines are equipped with carburetors. A fuel-air mixture generated by a carburetor is supplied to a crank chamber of a piston-valve two-stroke engine. The carburetors are roughly classified into a butterfly type and a rotary type depending on a type of an output control valve. A butterfly carburetor includes a butterfly valve. A rotary carburetor includes a rotary valve.

Patent Document 2 discloses a stratified scavenging two-stroke engine and a rotary carburetor incorporated therein. The stratified scavenging two-stroke engine includes an intake system having on the downstream side of the carburetor a fuel-air mixture passage communicating with the crank chamber and an air passage communicating with an upper part of a scavenging passage through a piston groove disposed on a circumferential surface of a piston, and the fuel-air mixture passage and the air passage are sectioned by a dividing wall. The dividing wall extends to a main body of the rotary carburetor. The rotary carburetor is supplied with an outside air filtered by an air cleaner.

Therefore, the outside air supplied to the rotary carburetor goes through the rotary carburetor and is divided to the air passage and the fuel-air mixture passage. The air passage is supplied with the outside air. The scavenging passage is filled with the outside air through the air passage. On the other hand, the fuel-air mixture passage is supplied with the fuel-air mixture generated by the carburetor, and the crank chamber is supplied with the fuel-air mixture through the fuel-air mixture passage.

The rotary carburetor disclosed in Patent Document 2 has a carburetor main body and a columnar rotary valve. The rotary valve has a through-hole with a circular cross section making up a gas passage. This through-hole extends in a direction orthogonal to an axis of the rotary valve. The carburetor main body rotatably accepting the rotary valve has an inlet and an outlet. The inlet of the carburetor main body is made up of a circular opening and the diameter of the circular opening is the same as the diameter of the through-hole of the rotary valve. The outlet of the carburetor main body is sectioned by a body dividing wall into two ports. A first port communicates with the air passage. A second port communicates with the fuel-air mixture passage. The air passage and the fuel-air mixture passage of the intake system are arranged in the extending direction of an axis of an engine cylinder. Describing by using terms "upper" and "lower" based on the top dead center and the bottom dead center of the engine, the air passage is located on the upper side and the fuel-air mixture passage is located on the lower side thereof.

The rotary carburetor disclosed in Patent Document 2 has a nozzle tube coaxial with the rotation axis of the rotary valve as is the case with the conventional carburetor. Fuel is supplied from this nozzle tube into the through-hole. The nozzle tube is fixed to the carburetor main body. Therefore, the rotary valve rotates relatively to the stationary nozzle tube. The rotary carburetor disclosed in Patent Document 2 has the rotation axis of the rotary valve positioned sideways. Therefore, the rotation axis of the rotary valve has an arrangement relation orthogonal to the axis of the engine cylinder. A fuel outlet opened in a circumferential wall of the nozzle tube is oriented to the second port of the carburetor main body, i.e., the port communicating with the fuel-air mixture passage. Describing by using the terms "upper" and "lower", the fuel outlet of the nozzle tube is oriented toward the lower side and the fuel discharged from this fuel outlet is directed through the second port of the carburetor main body to the fuel-air mixture passage.

A rotary carburetor of Patent Document 3 has a rotation axis of a rotary valve positioned sideways as is the case with the rotary carburetor of Patent Document 2. The rotary carburetor of Patent Document 3 includes a nozzle tube having a guide tube portion extending downward with a slope, and the fuel discharged from the fuel outlet is guided through this guide tube portion to the second port of the carburetor main body. Therefore, the fuel discharged from the fuel outlet of the nozzle tube is guided by the guide tube portion in an integral structure with the nozzle tube and is directed to the second port of the carburetor main body.

PRIOR ART DOCUMENTS

Patent Document 1: WO 98/57053A1
Patent Document 2: WO 2011/048674A1
Patent Document 3: WO 2011/048673A1

In Patent Document 2, since the periphery of the fuel outlet of the nozzle tube is open, a negative pressure generated in the through-hole of the rotary valve advantageously directly acts on the fuel outlet. The fuel outlet of the nozzle tube is formed by cutting out a portion of the circumferential wall of the nozzle tube into an inverted triangle shape. Therefore, the directionality cannot be applied only by the fuel outlet to the fuel discharged from this fuel outlet. Therefore, a portion of the fuel sucked out from the fuel outlet may diffuse into the first port of the outlet of the carburetor main body, i.e., the port communicating with the air passage.

The rotary carburetor of Patent Document 3 has the fuel outlet of the nozzle tube surrounded by the guide tube portion as described above. Therefore, an intake negative pressure generated in the through-hole of the rotary valve does not directly act on the fuel outlet. As a result, an amount of the fuel sucked out through the fuel outlet tends to be unstable.

SUMMARY OF THE INVENTION

It is an object of the present invention to provide a rotary carburetor for a two-stroke internal combustion engine capable of allowing an intake negative pressure to directly act on a fuel outlet formed on a nozzle tube and of guiding a fuel discharged from the fuel outlet of the nozzle tube to the fuel-air mixture passage.

According to the present invention, the technical problem described above is solved by a rotary carburetor (100, 200, 300, 400) for a stratified scavenging two-stroke engine first supplying an air filled in a scavenging passage to a combustion chamber and then supplying a fuel-air mixture in a crank chamber through the scavenging passage to the combustion chamber in a scavenging stroke, the rotary carburetor (100, 200, 300, 400) being applied to the two-stroke engine with an intake system having an air passage (22) supplying an air to the scavenging passage and a fuel-air mixture passage (24) supplying a fuel-air mixture to the crank chamber, the rotary carburetor comprising:

a rotary valve (12) having a through-hole (14) making up a gas passage of the carburetor;

a nozzle tube (28) supplying a fuel to the through-hole (14); and a guide (102, 402) guiding a fuel discharged from the nozzle tube (28) toward the fuel-air mixture passage (24), wherein a periphery of a fuel outlet (30) of the nozzle tube (28) is open.

According to the rotary carburetor of the present invention, since the periphery of the fuel outlet (30) of the nozzle tube (28) is open, a negative pressure generated in the through-hole (14) of the rotary valve (12) can be allowed to directly act on the fuel outlet (30). Since the fuel discharged from the fuel outlet (30) is guided by the guide (102, 402) to the fuel-air mixture passage (24), the fuel discharged from the fuel outlet (30) can be restrained from diffusing into the air passage (22).

DETAILED DESCRIPTION OF THE PRESENT INVENTION

Preferred embodiments of the present invention will now be described with reference to the accompanying drawings. A rotary carburetor according to the present invention is applied to a stratified scavenging two-cycle internal combustion engine as is the case with the rotary carburetors disclosed in Patent Documents 2 and 3. A basic structure of the rotary carburetor according to the present invention is substantially the same as the rotary carburetors disclosed in Patent Documents 2 and 3. This is the premise of the following description of embodiments and modification examples of the present invention.

Figure 1:
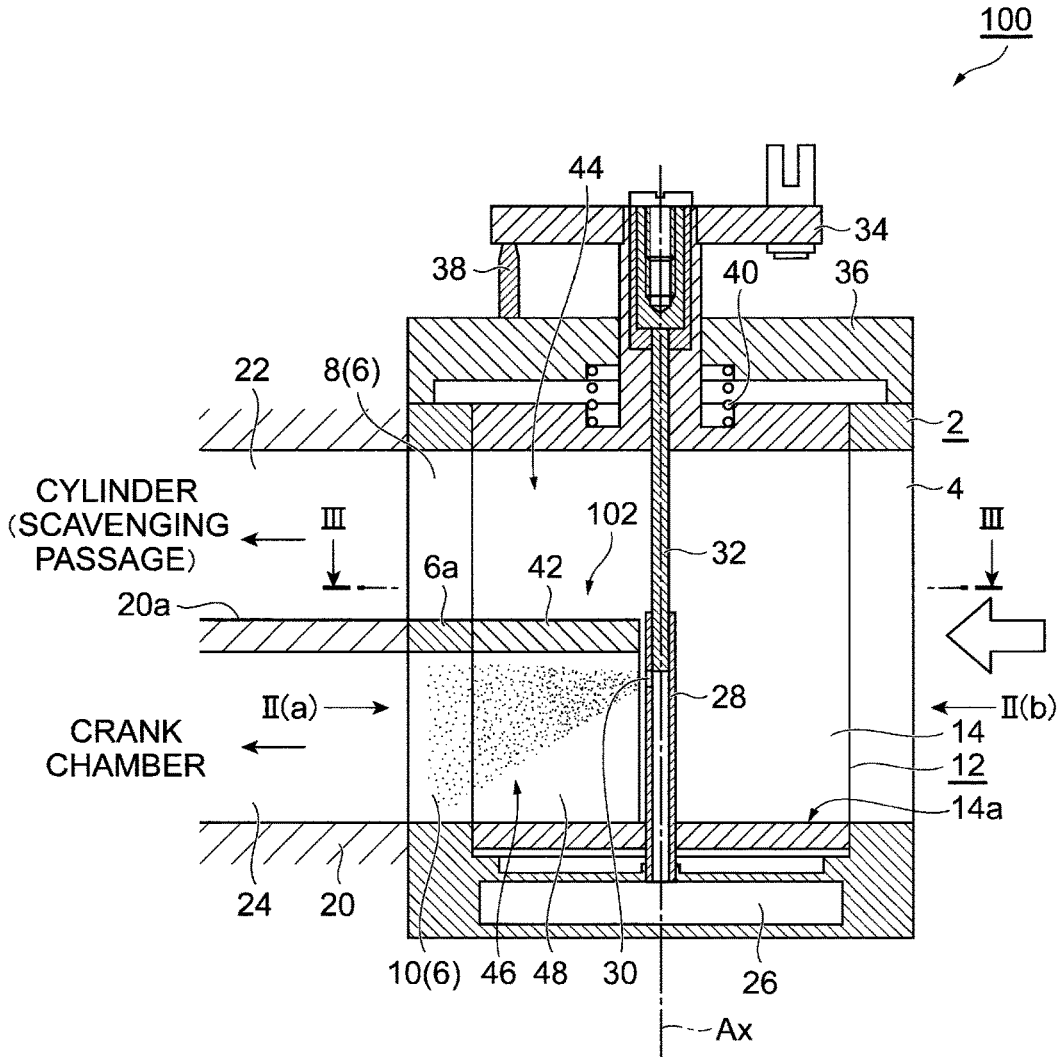
FIG. 1 shows a longitudinal sectional view of a rotary carburetor of a first embodiment.
Figure 2:
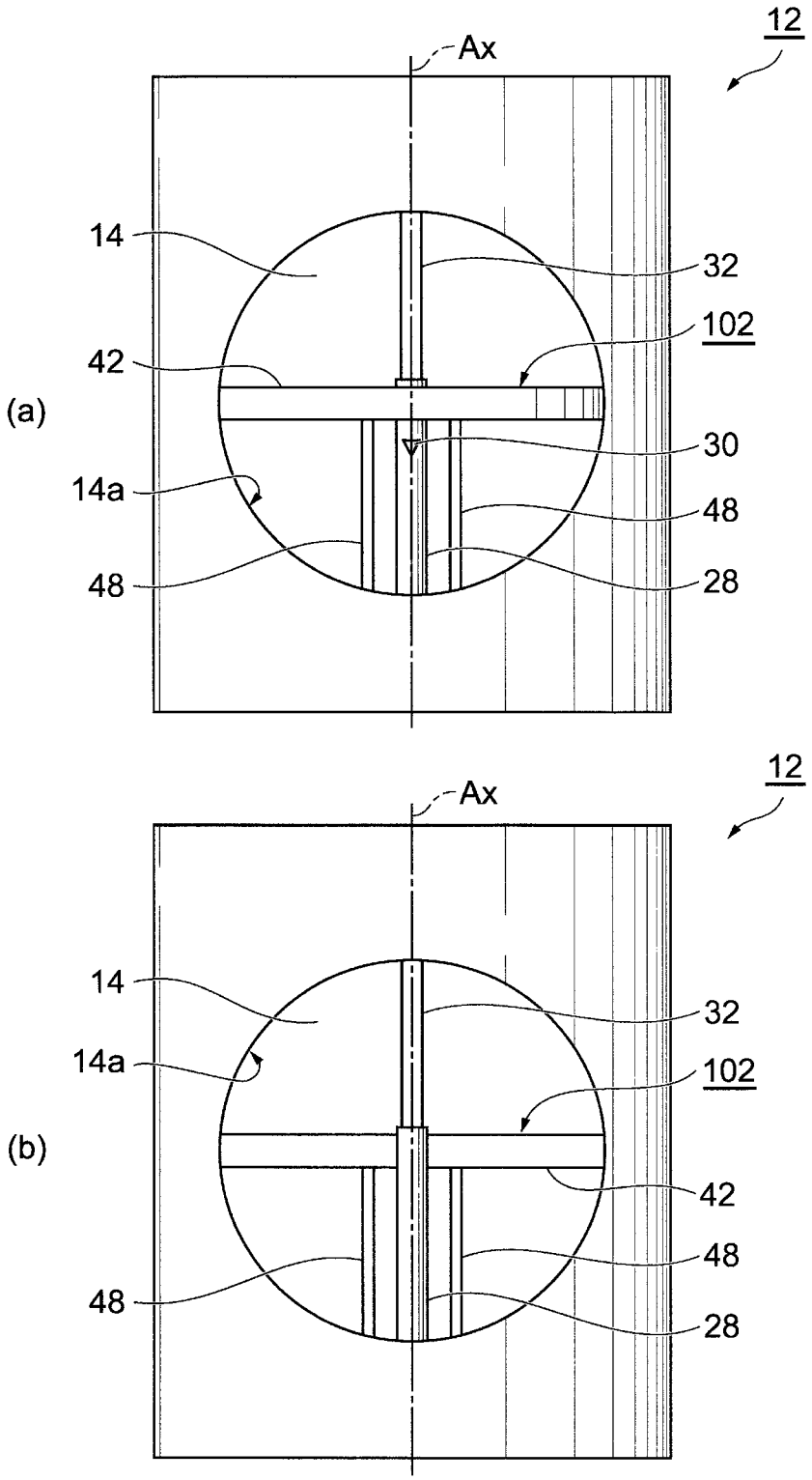
FIG. 2 shows a diagram for explaining a rotary valve taken out from the rotary carburetor of the first embodiment, including (a) an explanatory view in the direction of an arrow II(a) of FIG. 1 and (b) a view in the direction of an arrow II(b) of FIG. 1.
Figure 3:
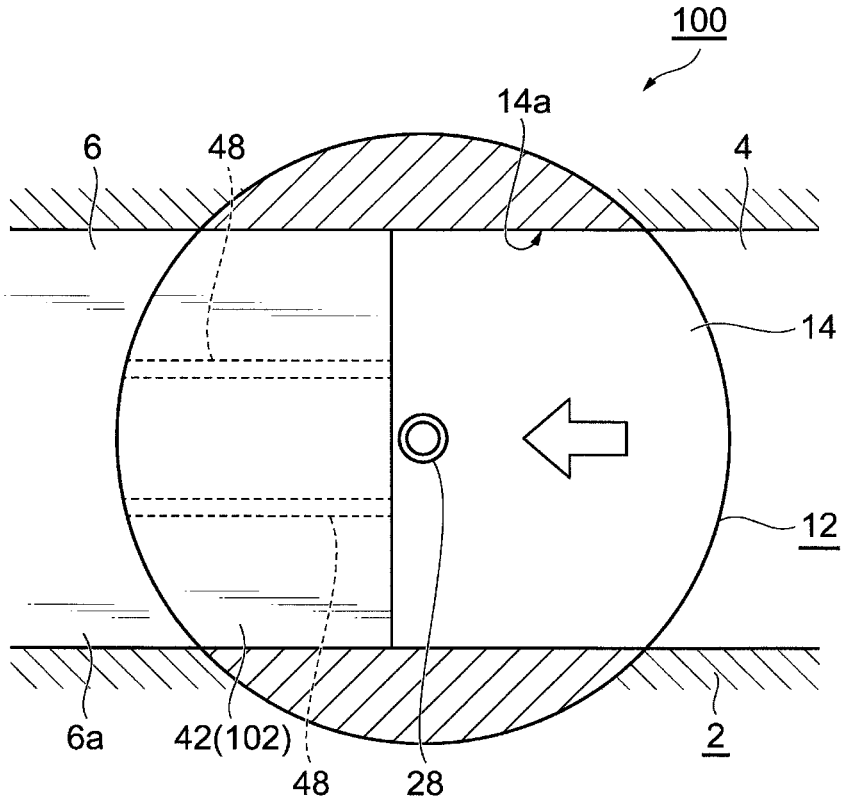
FIG. 3 shows a diagram for explaining a structure of the rotary valve included in the first embodiment and is a cross-sectional view taken along a line of FIG. 1.

First Embodiment (FIGS. 1 to 3)

FIG. 1 is a longitudinal sectional view of a rotary carburetor 100 of a first embodiment. The rotary carburetor 100 includes a main body 2 and a cylindrical rotary valve 12. The rotary valve 12 is housed rotatably around an axis Ax in the carburetor main body 2. The extending direction of the rotation axis Ax of the rotary valve 12 is the same as the extending direction of the cylinder axis of the stratified scavenging engine. The rotary valve 12 has a through-hole 14 making up a gas passage of the carburetor 100, and the through-hole 14 extends in the direction orthogonal to the rotation axis Ax. The through-hole 14 has a circular cross section over the entire length.

The carburetor main body 2 has an inlet 4 and an outlet 6, which are arranged oppositely to each other on the axis of the through-hole 14 of the rotary valve 12, and the inlet 4 and the outlet 6 have a circular shape with the same diameter as the diameter of the cross-sectional circular shape of the through-hole 14.

The rotary carburetor 100 is connected to an air cleaner not shown and the outside air filtered by the air cleaner is supplied to the inlet 4. The rotary carburetor 100 is connected through a flexible insulator 20 to the stratified scavenging engine and makes up a portion of an intake system of the stratified scavenging engine along with the insulator 20. The insulator 20 has an air passage 22 and a fuel-air mixture passage 24, and the air passage 22 and the fuel-air mixture passage 24 are preferably sectioned by a partition wall 20*a*.

Some of stratified scavenging engines have the air passage 22 and the fuel-air mixture passage 24 made up of respective independent pipelines.

The air passage 22 and the fuel-air mixture passage 24 are arranged in the extending direction of the cylinder axis of the stratified scavenging engine. Defining the extending direction of the rotation axis Ax of the rotary valve 12 in terms of the arrangement direction of the air passage 22 and the fuel-air mixture passage 24, the extending direction of the rotation axis Ax of the rotary valve 12 is the same as the arrangement direction of the air passage 22 and the fuel-air mixture passage 24. The air passage 22 communicates with an upper part of a scavenging passage of the stratified scavenging engine as is the case with the conventional carburetors. The fuel-air mixture passage 24 communicates with a crank chamber of the stratified scavenging engine as is the case with the conventional carburetors.

Defining the extending direction of the rotation axis Ax of the rotary valve 12 in terms of the top dead center and the bottom dead center of the engine, the rotation axis Ax vertically extends. The air passage 22 and the fuel-air mixture passage 24 are vertically arranged. Specifically, the air passage 22 and the fuel-air mixture passage 24 are located on the upper side and the lower side, respectively, across the partition wall 20*a*.

The outlet 6 of the rotary valve 12 is preferably divided into a first outlet portion 8 and a second outlet portion 10. In this embodiment, the outlet 6 is divided by a first dividing wall 6*a* into the first outlet portion 8 and the second outlet portion 10. The first outlet portion 8 communicates with the air passage 22 of the insulator 20. The second outlet portion 10 communicates with the fuel-air mixture passage 24 of the insulator 20.

The first dividing wall 6*a* of the outlet 6 of the carburetor 100 is not essential and the outlet 6 without the first dividing wall 6*a* may be used. In a modification example of the first dividing wall 6*a*, the first dividing wall 6*a* may be formed by extending the partition wall 20*a* of the insulator 20 described above. In particular, the partition wall 20*a* of the insulator 20 may be extended to the outlet 6 of the rotary carburetor 100 so that this extended portion makes up the first dividing wall 6*a*.

FIG. 2 is a diagram of the rotary valve 12 taken out from the carburetor main body 2, and FIG. 2(*a*) is a view in the direction of an arrow II(a) of FIG. 1 while FIG. 2(*b*) is a view in the direction of an arrow II(b) of FIG. 1. FIG. 3 is a cross-sectional view taken along a line of FIG. 1.

The rotary carburetor 100 will generally be described with reference to FIGS. 1 to 3. Referring to FIG. 1, the carburetor main body 2 has a fuel chamber 26 and a nozzle tube 28 communicating with the fuel chamber 26. The nozzle tube 28 has a cylindrical shape and has a base end part non-rotatably fixed to the carburetor main body 2. The nozzle tube 28 extends along the rotation axis Ax of the rotary valve 12 into the through-hole 14 of the rotary valve 12. The nozzle tube 28 is located on the rotation axis Ax. Therefore, the nozzle tube 28 is located on the same axis as the rotary valve 12.

An upper part, i.e., a free end portion, of the nozzle tube 28 has an inverted-triangular fuel outlet 30 opened in a peripheral wall of the nozzle tube 28 (FIG. 2). The fuel outlet 30 is opened to face the second outlet portion 10 of the carburetor main body 2. A leading end part of a solid needle 32 is inserted into the free end part of the nozzle tube 28. The needle 32 is located on the rotation axis Ax. The needle 32 is displaceable along the rotation axis Ax. The displacement of the needle 32 includes horizontal rotation and axial movement. The displacement of the needle 32 changes an effective opening area of the fuel outlet 30.

The needle 32 is displaced in accordance with the rotational operation of the lever 34 as is the case with the conventional carburetors. In FIG. 1, reference numeral 36 denotes a cover. Reference numeral 38 denotes a slope. Reference numeral 40 denotes a spring. The lever 34 is placed on the slope 38 and the slope 38 is biased by the spring 40 in the direction approaching the lever 34. As a result, the needle 32 is displaced as the lever 34 rotates. As described above, the displacement of the needle 32 includes the horizontal rotation and the axial movement (ascent and descent). An amount of the fuel discharged from the fuel outlet 30 is controlled through the displacement of the needle 32.

As can clearly be seen by reference to FIG. 3, the rotary valve 12 has a first guide 102 on the downstream side of the nozzle tube 28. The first guide 102 is substantially integral with the rotary valve 12 and therefore pivots as the rotary valve 12 pivots.

The first guide 102 has a flat plate-shaped guide plate member 42. The guide plate member 42 extends from the nozzle tube 28 to a downstream end of the through-hole 14 and is continuous with the first dividing wall 6*a* of the carburetor main body 2. Both side edges of the guide plate member 42 are continuous with an inner wall surface 14*a* of the through-hole 14. An upstream end of the guide plate member 42 may abut on the nozzle tube 28 or may slightly away from the nozzle tube 28.

Since the guide plate member 42 is disposed inside the through-hole 14, the through-hole 14 is sectioned in a portion downstream of the nozzle tube 28 by the guide plate member 42 into two passage portions. A first passage portion 44 communicates through the first outlet portion 8 with the air passage 22 of the insulator 20. A second passage portion 46 communicates through the second outlet portion 10 with the fuel-air mixture passage 24 of the insulator 20.

According to the first embodiment, the fuel discharged from the fuel outlet 30 of the nozzle tube 28 is guided by the guide plate member 42 to the second passage portion 46 and is then supplied through the second passage portion 46 to the fuel-air mixture passage 24. In other words, the fuel discharged from the fuel outlet 30 can be inhibited by the guide plate member 42 from diffusing into the first passage portion 44.

As can most clearly be seen from FIG. 2, the first guide 102 has two supporting members 48 making up portions of the guide plate member 42. These supporting members 48 are not essential. The supporting members 48 may not be included.

Referring to FIGS. 2 and 3, the two supporting members 48 are each made up of a flat plate and extend downward from the guide plate member 42. In a planar view, the two supporting members 48 are located on the both sides of the center line of the through-hole 14 and extend in parallel with each other. The two supporting members 48 have upstream ends aligning with the upstream end of the guide plate member 42, and downstream ends of the supporting members 48 align with the downstream end of the through-hole 14. The upstream ends of the supporting members 48 may obviously be located downstream of the upstream end of the guide plate member 42. Similarly, the downstream ends of the supporting members 48 may be located upstream of the downstream end of the through-hole 14.

In the shown example, the supporting members 48 extend downward from the guide plate member 42. In a modification example, the supporting members 48 may extend upward from the guide plate member 42. In other words, a configuration of hanging the guide plate member 42 by the supporting members 48 may be adopted.

By the two supporting members 48 extending downward from the guide plate member 42, the fuel discharged from the fuel outlet 30 can be guided in a concentrated state in a central portion of the second passage portion 46 to the fuel-air mixture passage 24.

Additionally, the carburetor 100 of the first embodiment can effectively guide the fuel discharged from the fuel outlet 30 to the fuel-air mixture passage 24 while suppressing mixture between the air supplied to the stratified scavenging engine and the fuel-air mixture. Since the nozzle tube 28 is in an opened space on the upstream side, the air entering the fuel-air mixture passage 24 can be ensured from the whole air that have entered the inlet 4 of the carburetor 100. Therefore, the engine can be maintained at a good delivery ratio.

Figure 4:
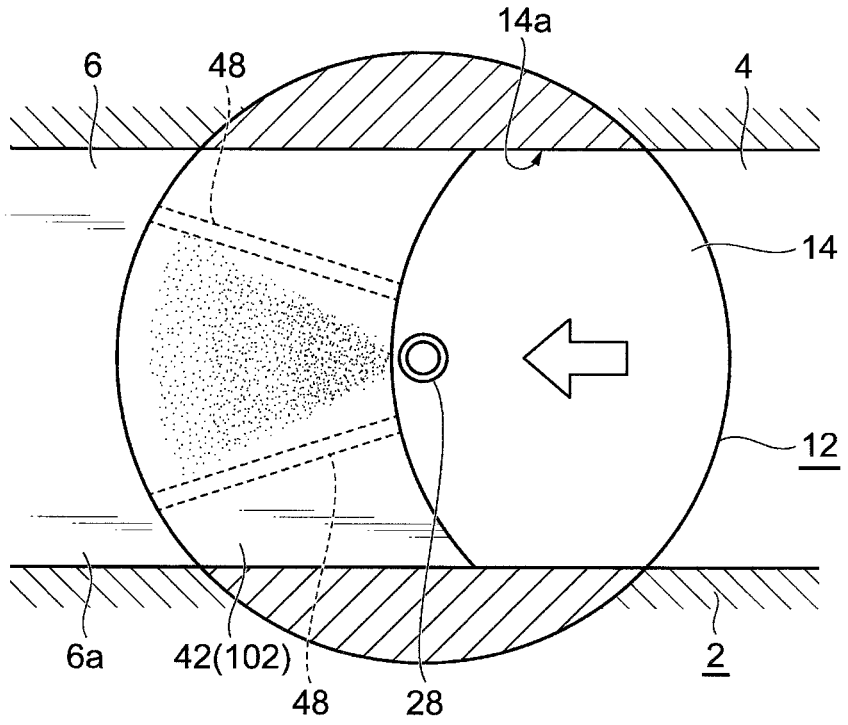
FIG. 4 shows a diagram for explaining a modification example of the rotary valve included in the first embodiment, corresponding to FIG. 3.
Figure 5:
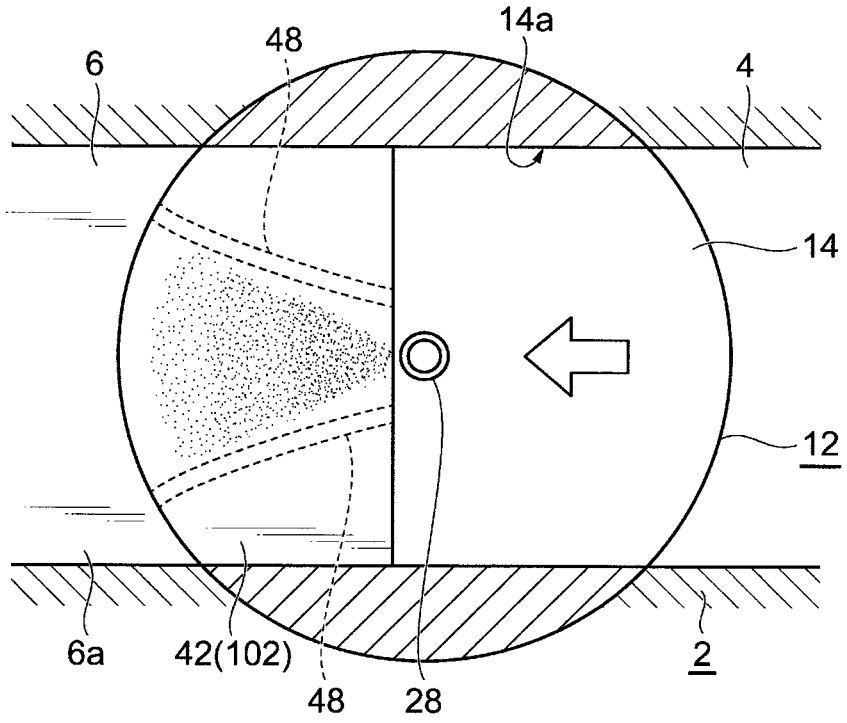
FIG. 5 shows a diagram for explaining another modification example of the rotary valve included in the first embodiment, corresponding to FIG. 3.
Figure 6:
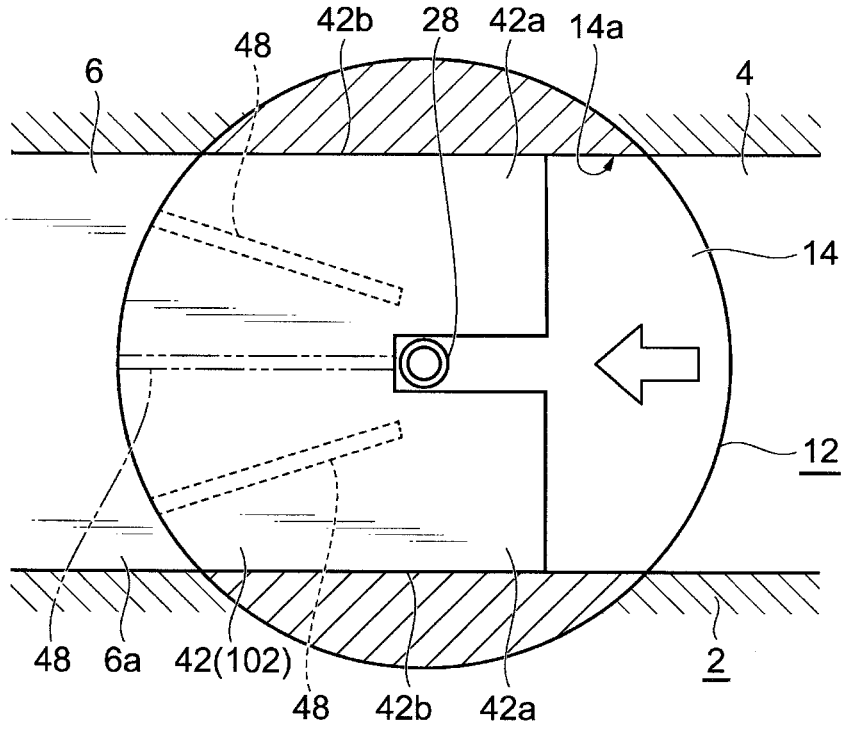
FIG. 6 shows a diagram for explaining a further modification example of the rotary valve included in the first embodiment, corresponding to FIG. 3.

Modification Examples (FIGS. 4 to 6)

With regard to the arrangement of the supporting members 48, as shown in FIG. 4, the two supporting members 48 may be arranged to spread toward the downstream side. Alternatively, as shown in FIG. 5, each of the two supporting members 48 may have a curved shape such that the two supporting members 48 are gradually separated from each other as the members extend toward the downstream side.

With regard to the number of the supporting members 48, as indicated by imaginary lines in FIG. 6, one member may serve as the supporting member 48. The one supporting member 48 is preferably disposed at a central portion in the width direction of the guide plate member 42.

Describing modification examples in terms of the shape of the guide plate member 42 in a planar view, as shown in FIG. 4, the upstream end edge of the guide plate member 42 may have a curved shape recessed toward the downstream side. Alternatively, as shown in FIG. 6, the guide plate member 42 may have extension parts 42*a* extending from the both sides across the nozzle tube 28 toward the upstream side.

Figure 7:
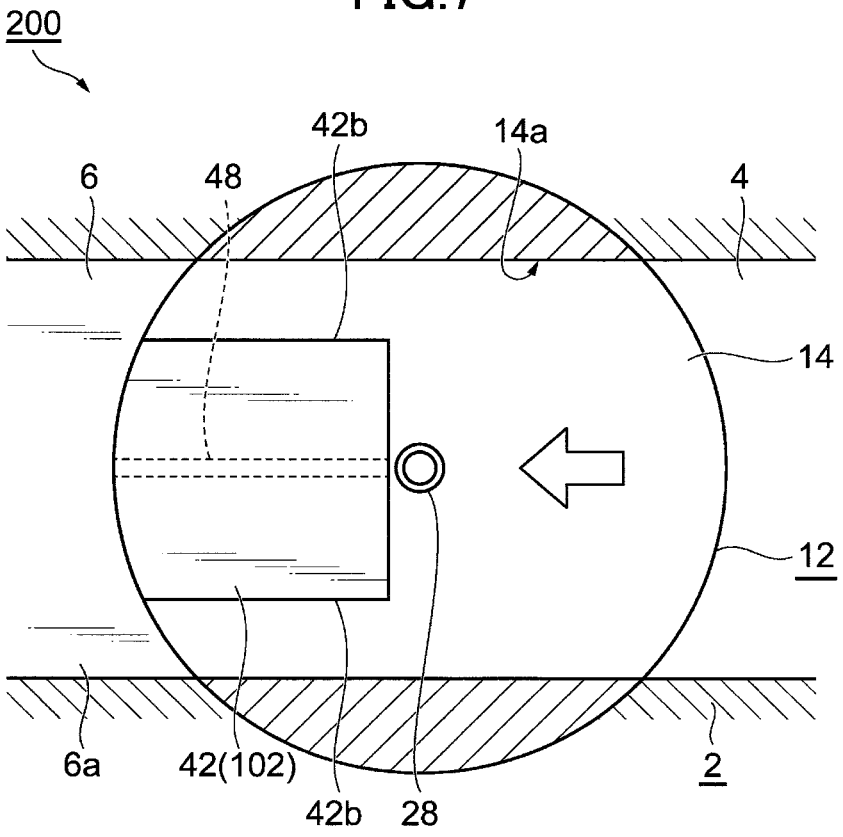
FIG. 7 shows a diagram for explaining a rotary valve included in a second embodiment, corresponding to FIG. 3.

Second Embodiment (FIG. 7)

FIG. 7 is a diagram for explaining a rotary carburetor 200 of a second embodiment and is a diagram corresponding to FIG. 3. Referring to FIG. 7, the guide plate member 42 may have both side edges 42*b* away from the inner wall surface 14*a* of the through-hole 14. The guide plate member 42 included in the second embodiment has the both side edges 42*b* extending in parallel with each other. One member serves as the supporting member 48 of the guide plate member 42 and this one supporting member 48 is positioned at a central portion in the width direction of the guide plate member 42.

Also in the rotary carburetor 200 of the second embodiment, the guide plate member 42 is substantially integral with the rotary valve 12 and therefore pivots as the rotary valve 12 pivots. In the rotary carburetor 200 of the second embodiment, particularly at the time or operation with the rotary valve 12 fully-opened, the function effectively works for guiding the fuel discharged from the fuel outlet 30 by the guide plate member 42 to the second passage portion 46. In an idle operation or an operational state in which the rotary valve 12 is partially opened, a portion of the fuel discharged from the fuel outlet 30 enters the first passage portion 44. As a result, the engine operational state is stabilized in the idle operation or the state in which the rotary valve 12 is partially opened, and the engine responsivity can be enhanced at the time of acceleration.

Modification Examples (FIGS. 8 to 13)

Figure 8:
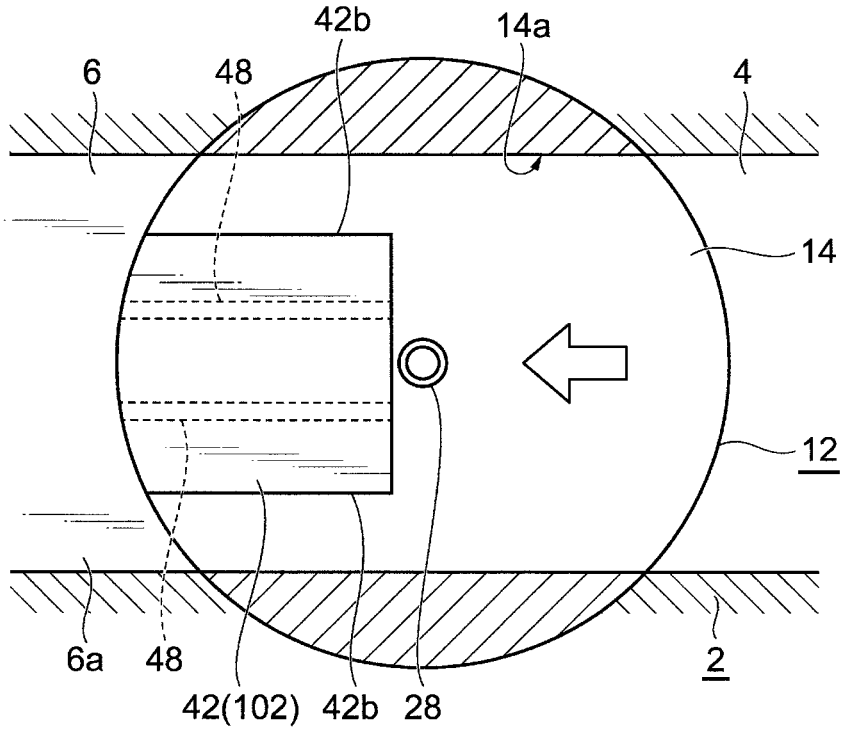
FIG. 8 shows a diagram for explaining a structure of a rotary valve included in a rotary carburetor of the second embodiment, corresponding to FIG. 3.
Figure 9:
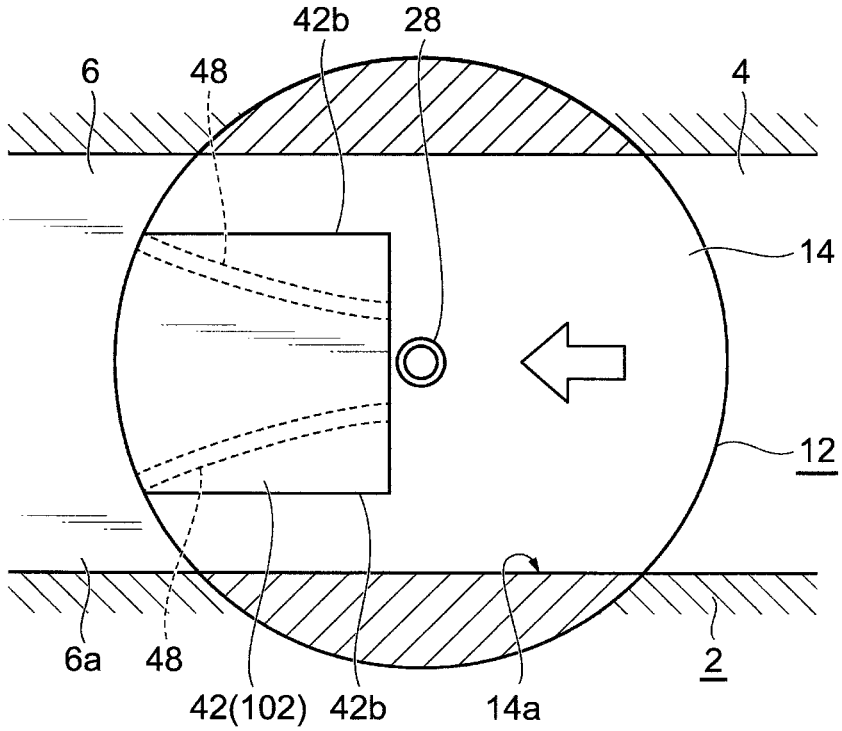
FIG. 9 shows a diagram for explaining a modification example of the rotary valve included in the second embodiment, corresponding to FIG. 3.

The second embodiment may include the two supporting members 48, and the two supporting members 48 may be arranged in parallel with each other (FIG. 8). As can be seen from FIG. 9, the two supporting members 48 may be arranged to spread toward the downstream side. Although FIG. 9 shows an example of the two supporting members 48 each having a curved shape, the supporting members 48 may be flat plates as is the case with the example of FIG. 8.

Figure 10:
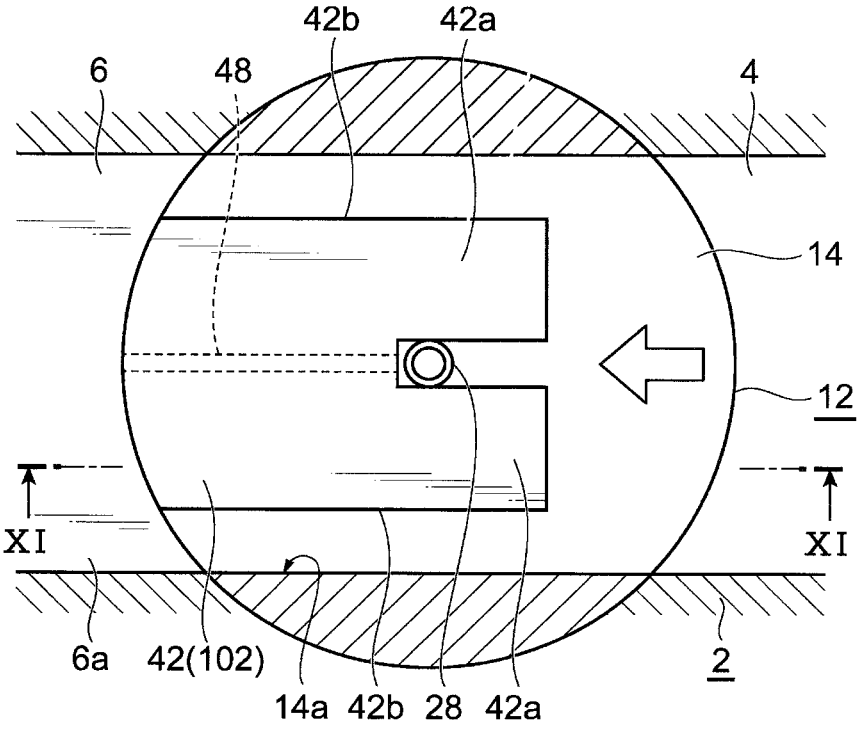
FIG. 10 shows a diagram for explaining another modification example of the rotary valve included in the second embodiment, corresponding to FIG. 3.
Figure 11:
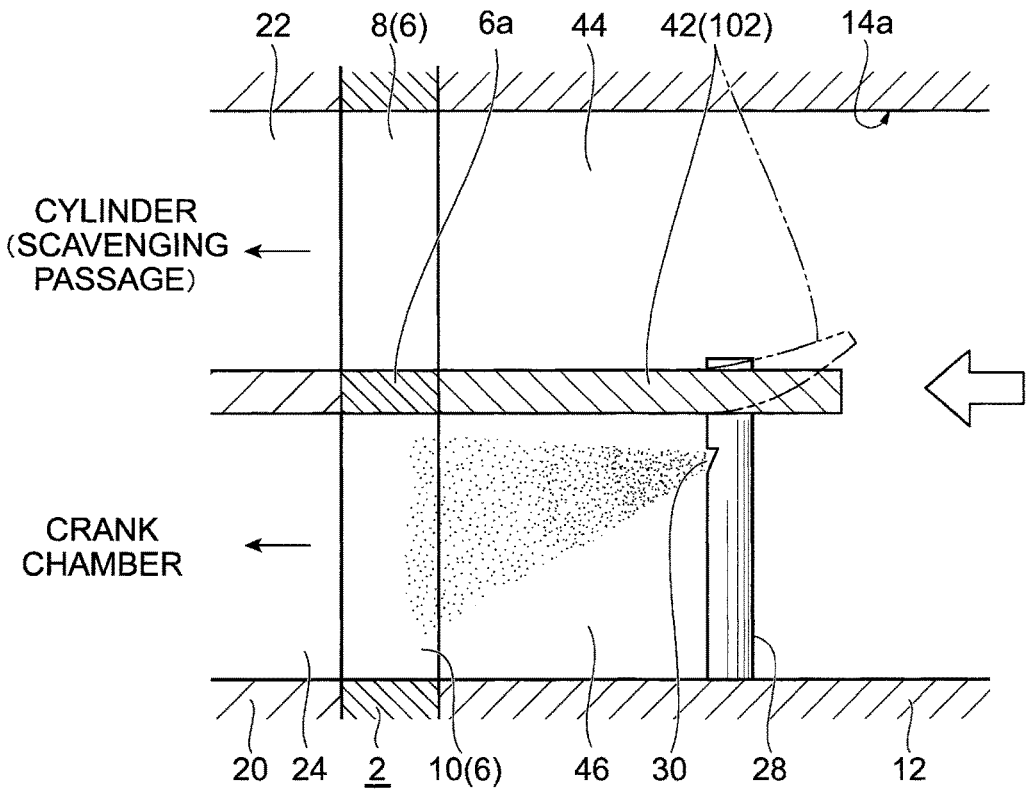
FIG. 11 shows a diagram for explaining a cross-sectional shape of a guide plate member shown in FIG. 10.

FIG. 10 shows an example of the guide plate member 42 having the extension parts 42*a* extending on the both sides across the nozzle tube 28 as is the case with the example of FIG. 6. The extension parts 42*a* may have a shape extending toward the first passage portion 44 as the extension parts go toward the upstream side (FIG. 11).

Figure 12:
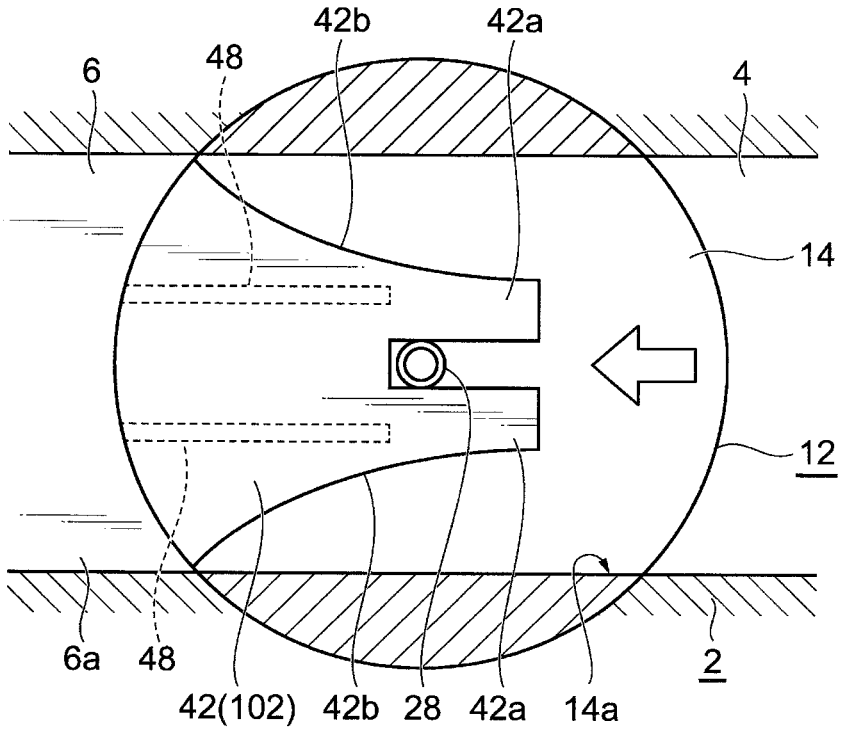
FIG. 12 shows a diagram for explaining a further modification example of the rotary valve included in the second embodiment, corresponding to FIG. 3.
Figure 13:
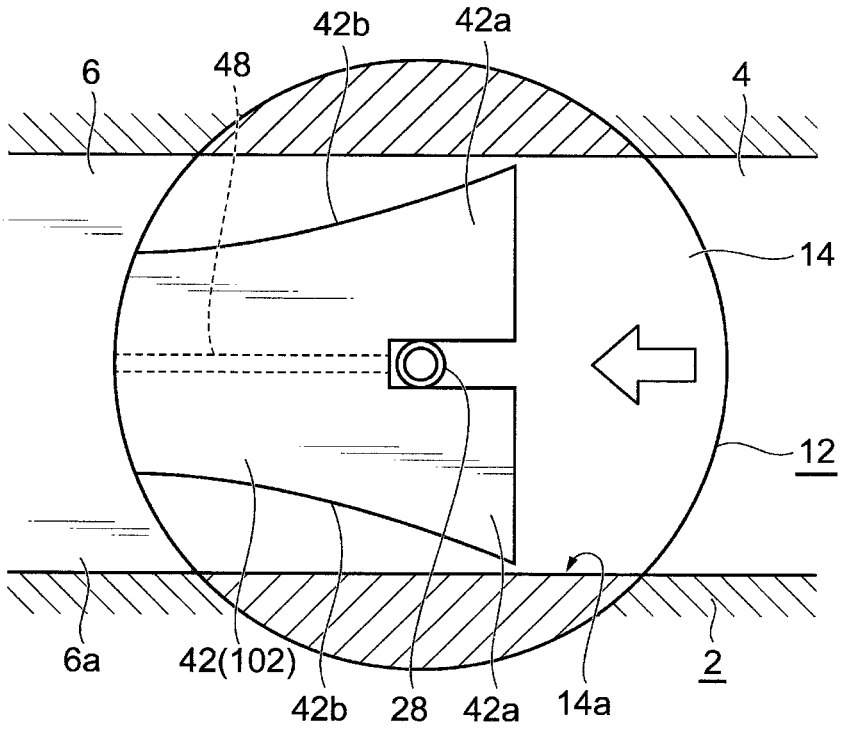
FIG. 13 shows a diagram for explaining a yet further modification example of the rotary valve included in the second embodiment, corresponding to FIG. 3.

FIGS. 12 and 13 are diagrams for explaining modification examples of the shape of the guide plate member 42 in the planar view. As shown in FIG. 12, the guide plate member 42 may have a shape tapered toward the upstream side. Conversely, as shown in FIG. 13, the guide plate member 42 may have a shape tapered toward the downstream side.

Figure 14:
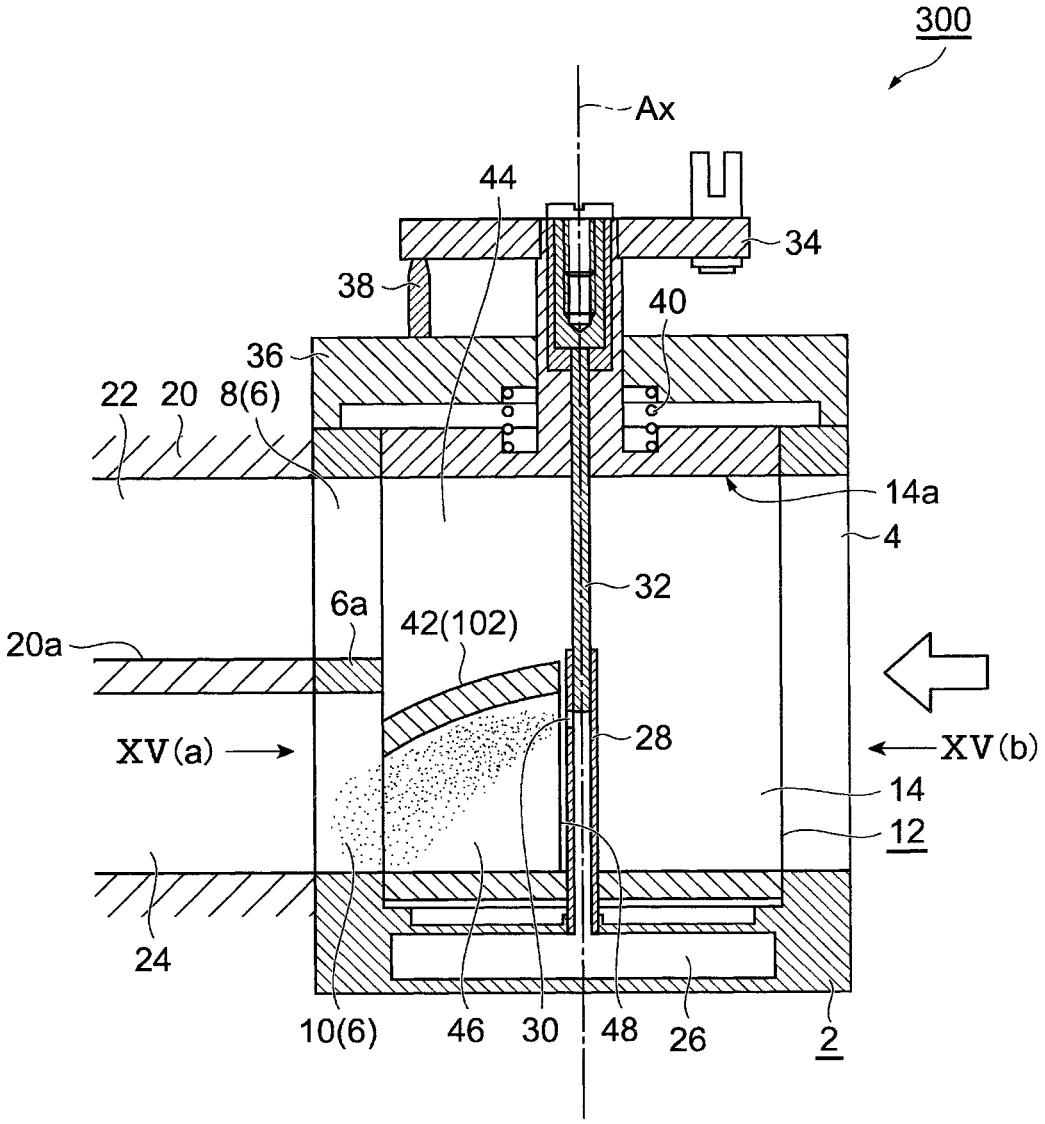
FIG. 14 shows a diagram for explaining a rotary carburetor of a third embodiment and a structure of a rotary valve included therein, corresponding to FIG. 1.
Figure 15:
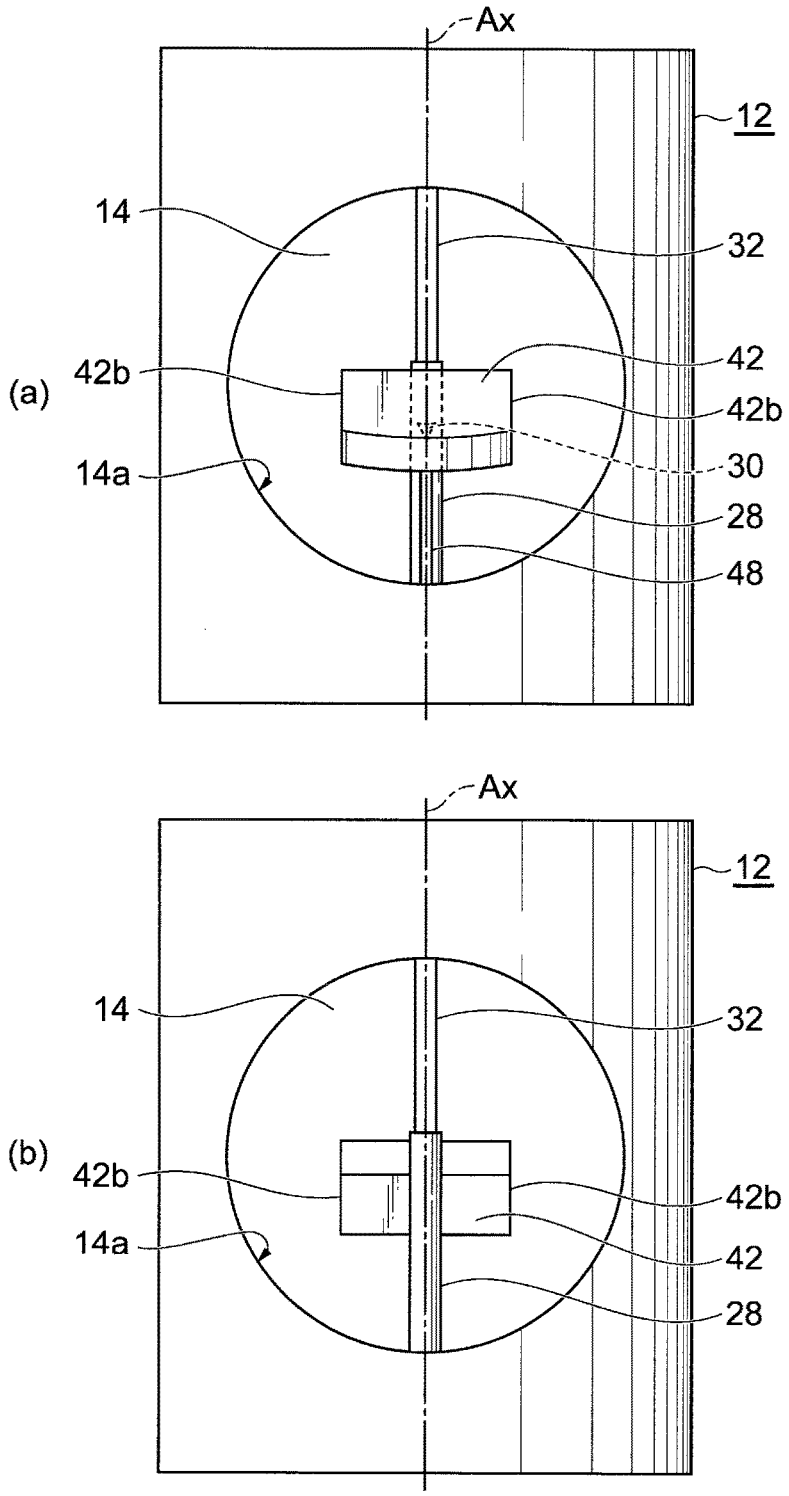
FIG. 15 shows a diagram for explaining the rotary valve taken out from the rotary carburetor of the third embodiment, including (a) an explanatory view in the direction of an arrow XV(a) of FIG. 14 and (b) a view in the direction of an arrow XV(b) of FIG. 14.

Third Embodiment (FIGS. 14 and 15)

FIG. 14 is a longitudinal sectional view of a rotary carburetor 300 of a third embodiment, corresponding to FIG. 1. FIG. 15 is a diagram for explaining the rotary valve 12 taken out from the rotary carburetor 300 of the third embodiment, and FIG. 15(*a*) is a view in the direction of an arrow XV(a) of FIG. 14 while FIG. 15(*b*) is a view in the direction of an arrow XV(b) of FIG. 14.

The guide plate member 42 included in the third embodiment is disposed with a slope toward the downstream side. In particular, the guide plate member 42 has an upstream end located in the vicinity of the nozzle tube 28 and a downstream end positioned at a position more distant from the first passage portion 44. In other words, when the guide plate member 42 is viewed from the side, the guide plate member 42 has a sloped form or shape with the downstream end located lower than the upstream end. The guide plate member 42 may have the upstream end located at the same height level as the axis of the through-hole 14 (FIG. 14) or located at a height level higher than the axis of the through-hole 14.

When the guide plate member 42 is viewed from the side, the sloped guide plate member 42 may have the downstream end located at a height level lower than the axis of the through-hole 14 (FIG. 14) or located at the same height level as the axis of the through-hole 14.

As can be well understood from FIG. 14, the fuel discharged from the fuel outlet 30 of the nozzle tube 28 is guided by the sloped guide plate member 42 to the fuel-air mixture passage 24.

Modification Examples (FIGS. 16 to 20)

Figure 16:
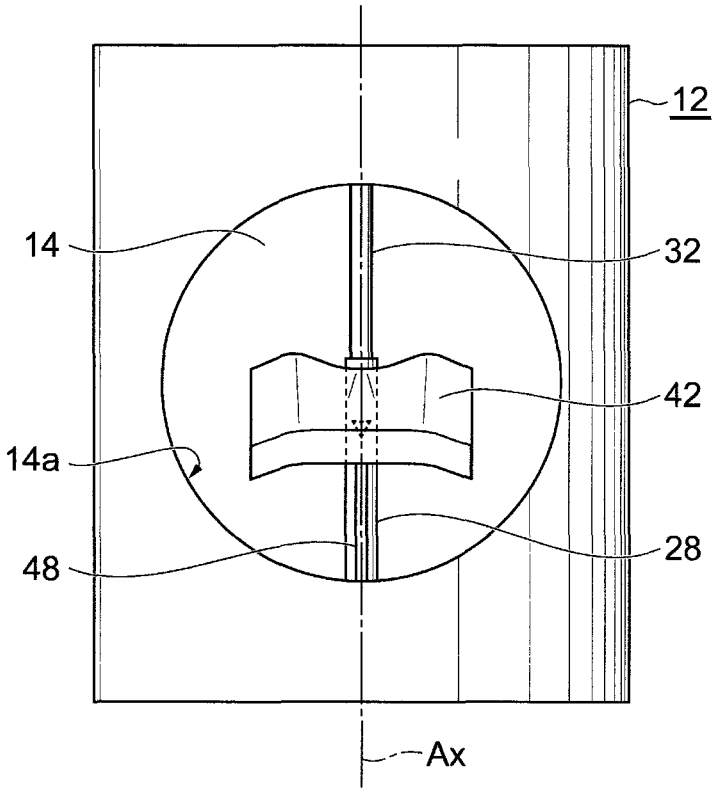
FIG. 16 shows a diagram for explaining a modification example of the rotary valve included in the rotary carburetor of the third embodiment, corresponding to FIG. 15(*a*).
Figure 17:
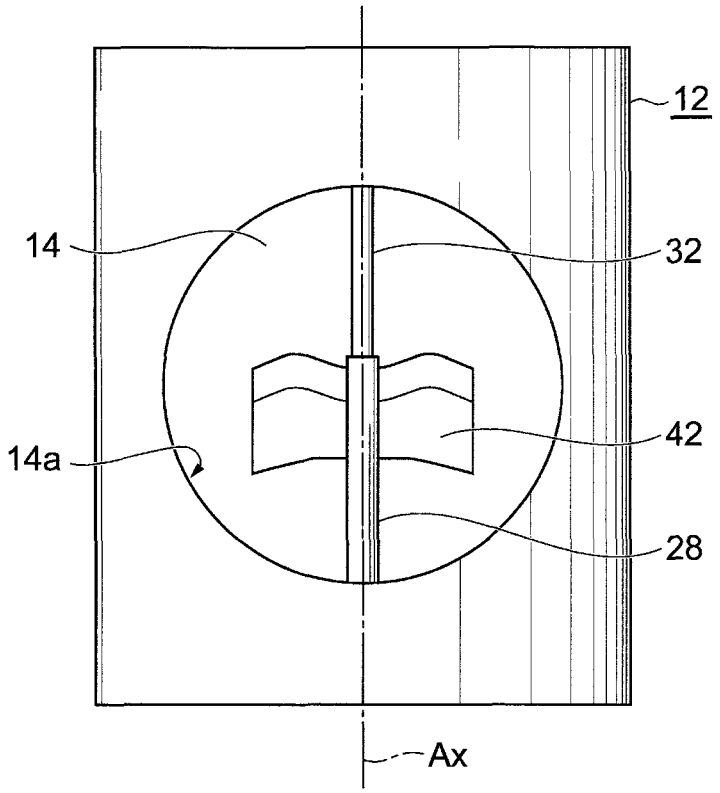
FIG. 17 shows a diagram for explaining a modification example of the rotary valve included in the rotary carburetor of the third embodiment, corresponding to FIG. 15(*b*).

FIGS. 16 to 20 show a plurality of modification examples. FIGS. 16 and 17 show a first modification example. FIG. 16 corresponds to FIG. 15(*a*). FIG. 17 corresponds to FIG. 15(*b*). As can be seen from FIGS. 16 and 17, the guide plate member 42 has a wave shape waved in the width direction.

Figure 18:
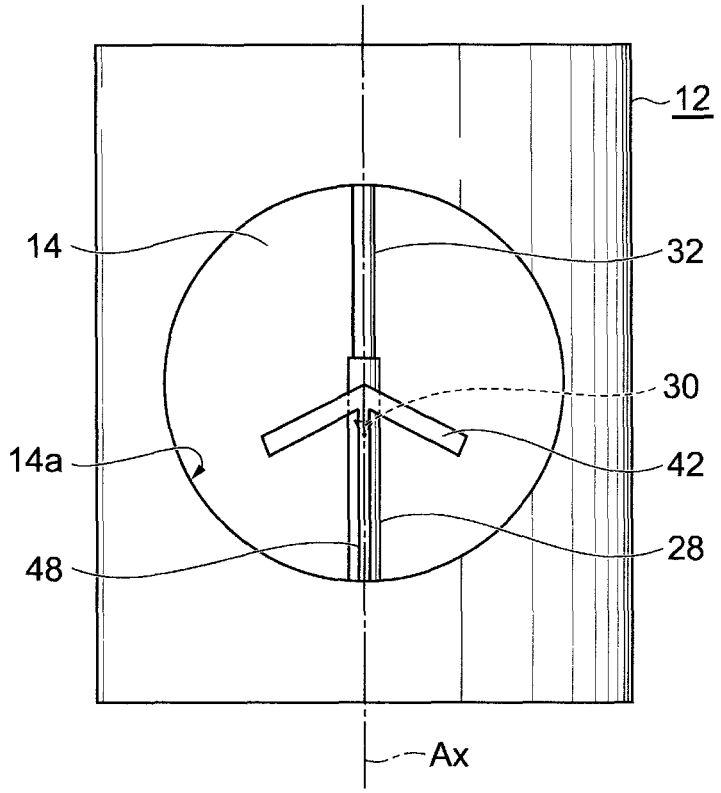
FIG. 18 shows a diagram for explaining another modification example of the rotary valve included in the rotary carburetor of the third embodiment, corresponding to FIG. 15(*a*).

FIG. 18 shows a second modification example. FIG. 18 corresponds to FIGS. 15(*a*) and 16. When viewed from an end surface, the guide plate member 42 may have an inverted V-shape with the central portion in the width direction projected toward the first passage portion 44.

Figure 19:
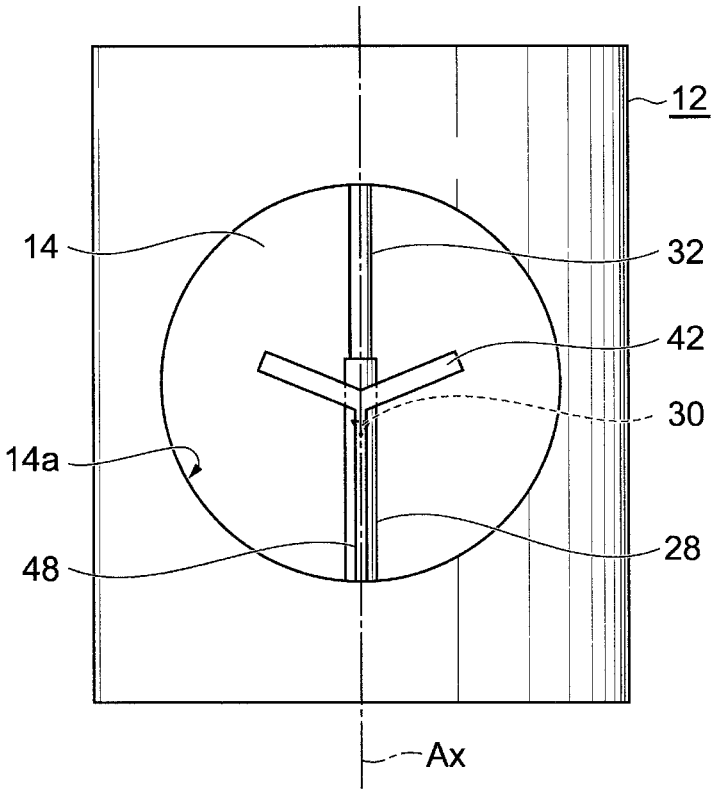
FIG. 19 shows a diagram for explaining a further modification example of the rotary valve included in the rotary carburetor of the third embodiment, corresponding to FIG. 15(*a*).

FIG. 19 shows a third modification example. FIG. 19 corresponds to FIGS. 15(*a*) and 16. When viewed from an end surface, the guide plate member 42 may have a V-shape with the central portion in the width direction projected toward the second passage portion 46.

Figure 20:
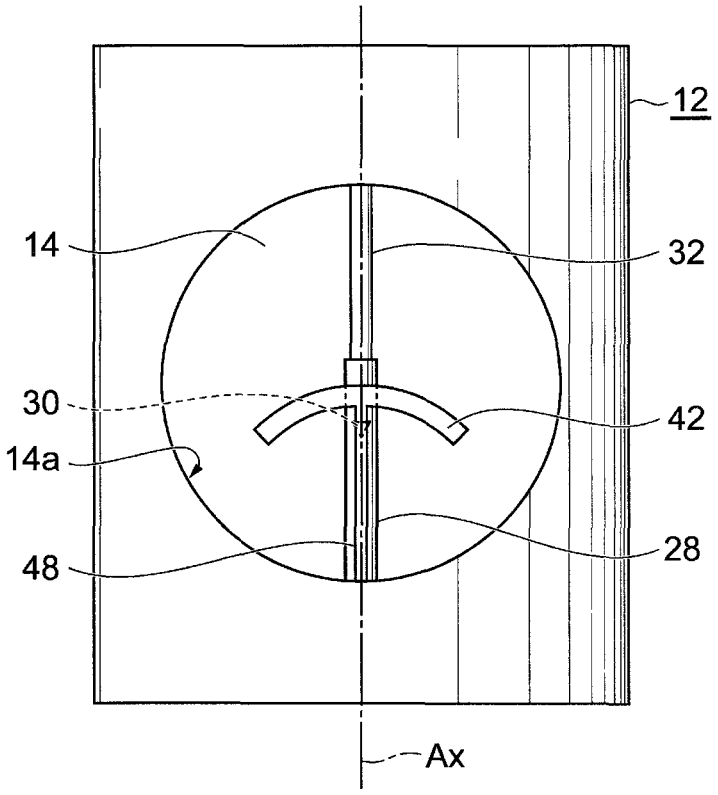
FIG. 20 shows a diagram for explaining a yet further modification example of the rotary valve included in the rotary carburetor of the third embodiment, corresponding to FIG. 15(*a*).

FIG. 20 shows a fourth modification example. FIG. 20 corresponds to FIGS. 15(*a*) and 16. When viewed from an end surface, the guide plate member 42 may have a curved shape with the central portion in the width direction convex toward the first passage portion 44. With regard to this curved shape, contrary to FIG. 20, the central portion in the width direction of the guide plate member 42 may have a curved shape convex toward the second passage portion 46.

Figure 21:
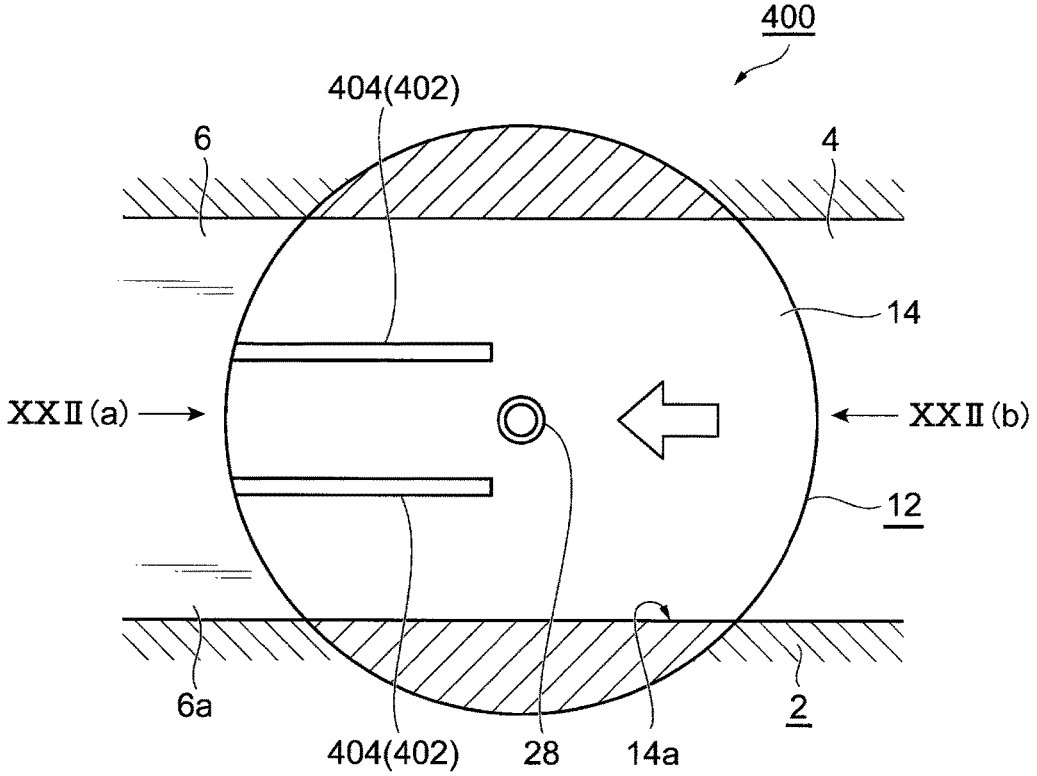
FIG. 21 shows a diagram for explaining a rotary carburetor of a fourth embodiment, corresponding to FIG. 3.
Figure 22:
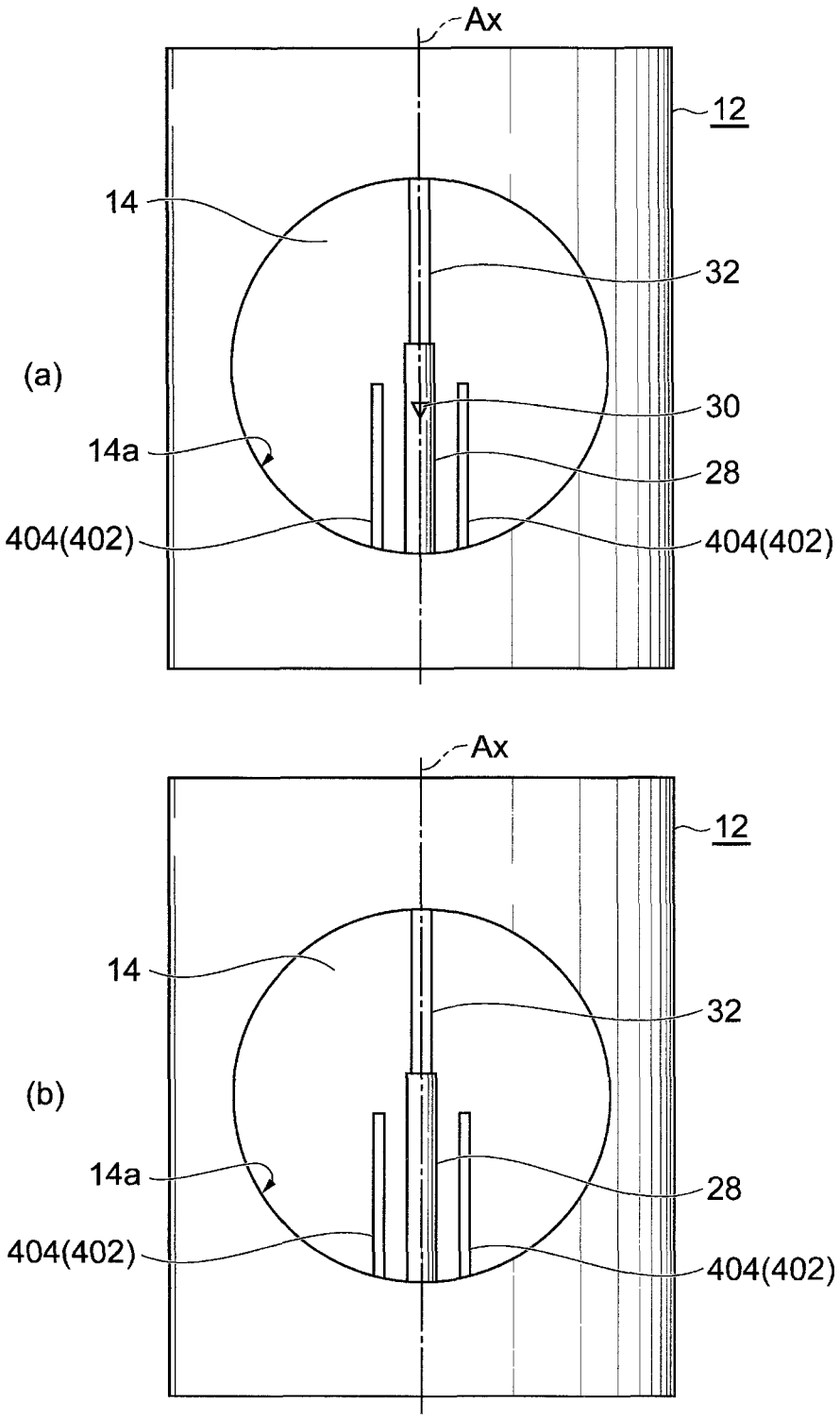
FIG. 22 shows a diagram for explaining a rotary valve taken out from the rotary carburetor of the fourth embodiment, including (a) an explanatory view in the direction of an arrow XXII(a) of FIG. 21 and (b) a view in the direction of an arrow XXII(b) of FIG. 21.

Fourth Embodiment (FIGS. 21 and 22)

FIGS. 21 and 22 are diagrams for explaining a rotary carburetor 400 of a fourth embodiment. FIG. 21 corresponds to FIG. 3. FIG. 22 is a diagram for explaining the rotary valve 12 taken out from the rotary carburetor 400 of the fourth embodiment, and FIG. 22(*a*) is a view in the direction of an arrow XXII(a) of FIG. 21. FIG. 22(*b*) is a view in the direction of an arrow XXII(b) of FIG. 21.

The rotary valve 12 included in the fourth embodiment has a second guide 402 made up of the two supporting members 48 included in the first embodiment. In particular, the second guide 402 is made up of two standing plates 404 extending in parallel with each other in a planar view. This second guide 402 (the two standing plates 404) can guide the fuel discharged from the fuel outlet 30 of the nozzle tube 28 to the fuel-air mixture passage 24 while inhibiting the fuel from diffusing in the width direction of the through-hole 14.

Figure 23:
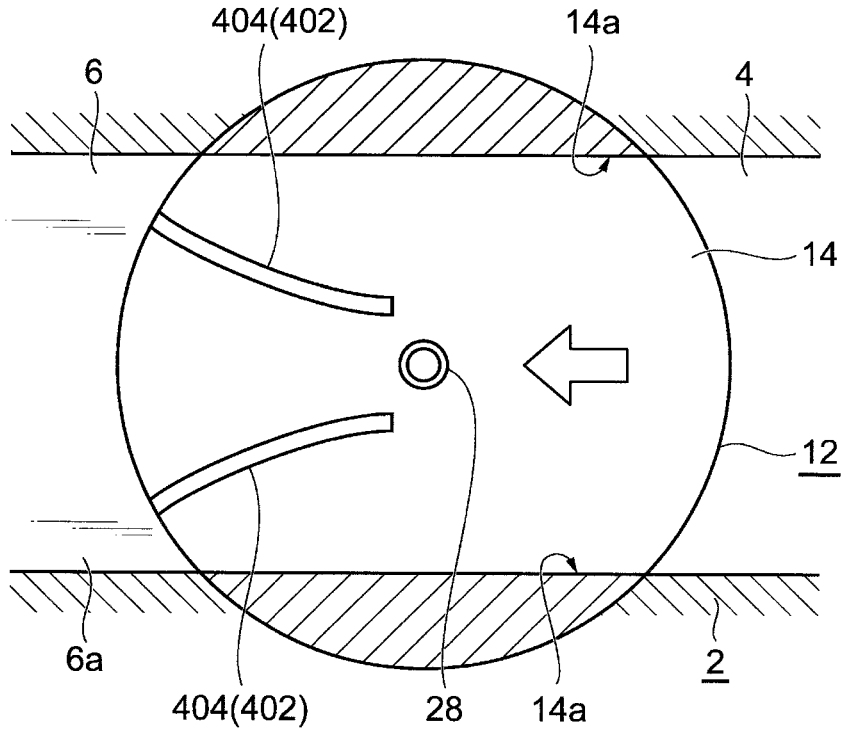
FIG. 23 shows a diagram for explaining a modification example of the rotary valve included in the rotary carburetor of the fourth embodiment, corresponding to FIG. 21.

Modification Example (FIG. 23)

Although the second guide 402 depicted in FIG. 22 is made up of the two standing plates 404 extending in parallel with each other, the two standing plates 404 in an modification example may have a shape coming closer to the inner wall surface 14*a* of the through-hole 14 toward the downstream side. In particular, the two standing plates 404 may be arranged such that a distance therebetween becomes lager on the downstream side than the upstream side.

The embodiments and modification examples of the present invention have been described. The present invention is not limited to these embodiments and modification examples. The embodiments and modification examples can arbitrarily be combined within the scope of the present invention.

The rotary carburetor according to the present invention may have, for example, a Venturi tube in the vicinity of the fuel outlet 30 of the nozzle tube 28 described above. This Venturi tube is disposed with an upstream end opening facing the fuel outlet 30 and a downstream end opening facing the fuel-air mixture passage 24. The Venturi tube may have an opening area larger at the downstream end opening than the upstream end opening.

The present invention is also applicable to the rotary carburetors with the rotation axis Ax of the rotary valve 12 positioned sideways (Patent Documents 2, 3).

EXPLANATIONS OF LETTERS OR NUMERALS

100 rotary carburetor of the first embodiment
102 first guide
2 carburetor main body
4 inlet of the carburetor main body
6 outlet of the carburetor main body
8 first outlet portion (air)
10 second outlet portion (fuel-air mixture)
12 rotary valve
Ax rotation axis of the rotary valve
14 through-hole of the rotary valve
20 insulator
22 air passage of the rotary valve
24 fuel-air mixture passage of the insulator
28 nozzle tube
30 fuel outlet of the nozzle tube
32 needle
42 guide plate member making up the first guide of the rotary valve
42*a* extension part of the guide plate member
42*b* side edge of the guide plate member
44 first passage portion of the through-hole
46 second passage portion of the through-hole
200 rotary carburetor of the second embodiment
300 rotary carburetor of the third embodiment
400 rotary carburetor of the fourth embodiment
402 second guide of the rotary carburetor of the fourth embodiment
404 standing plate making up the second guide

What is claimed is:

1. A rotary carburetor for a stratified scavenging two-stroke engine first supplying an air filled in a scavenging passage to a combustion chamber and then supplying a fuel-air mixture in a crank chamber through the scavenging passage to the combustion chamber in a scavenging stroke, the rotary carburetor being applied to the two-stroke engine with an intake system having an air passage supplying an air to the scavenging passage and a fuel-air mixture passage supplying a fuel-air mixture to the crank chamber, the rotary carburetor comprising:

a rotary valve having a through-hole making up a gas passage of the carburetor;

a nozzle tube supplying a fuel to the through-hole; and a guide guiding the fuel discharged from the nozzle tube toward the fuel-air mixture passage, wherein a periphery of a fuel outlet of the nozzle tube is open, wherein the guide is located downstream of the nozzle tube, and the guide is made up of a guide plate member located in a downstream portion of the through-hole relative to the nozzle tube, wherein the guide plate member divides at least a portion of the downstream portion of the through-hole into a first passage portion and a second passage portion, wherein the first passage portion communicates with the air passage, wherein the second passage portion communicates with the fuel-air mixture passage, and wherein the guide plate member has both side edges away from an inner wall surface of the through-hole.

2. The rotary carburetor for a stratified scavenging two-stroke engine of claim 1, wherein the guide plate member has extension parts extending on the upstream side relative to the nozzle tube.

3. The rotary carburetor for a stratified scavenging two-stroke engine of claim 2, wherein the extension parts are sloped.

4. The rotary carburetor for a stratified scavenging two-stroke engine of claim 3, wherein the guide plate member has both side edges away from an inner wall surface of the through-hole.

5. The rotary carburetor for a stratified scavenging two-stroke engine of claim 1, wherein the guide plate member is disposed with a slope.

6. The rotary carburetor for a stratified scavenging two-stroke engine of claim 1, wherein the fuel outlet is directed toward the fuel-air mixture passage.

7. The rotary carburetor for a stratified scavenging two-stroke engine of claim 1, wherein the rotation axis of the rotary valve extends in an arrangement direction of the air passage and the fuel-air mixture passage.

* * * * *